US011548287B2

(12) United States Patent
Chen et al.

(10) Patent No.: US 11,548,287 B2
(45) Date of Patent: Jan. 10, 2023

(54) FLUIDIC DIE ASSEMBLIES WITH RIGID BENT SUBSTRATES

(71) Applicant: Hewlett-Packard Development Company, L.P., Spring, TX (US)

(72) Inventors: Chien-Hua Chen, Corvallis, OR (US); Michael W. Cumbie, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/251,263

(22) PCT Filed: Nov. 14, 2018

(86) PCT No.: PCT/US2018/060900

§ 371 (c)(1),
(2) Date: Dec. 11, 2020

(87) PCT Pub. No.: WO2020/101659

PCT Pub. Date: May 22, 2020

(65) Prior Publication Data

US 2021/0323312 A1 Oct. 21, 2021

(51) Int. Cl.
*B41J 2/175* (2006.01)
*B41J 2/16* (2006.01)

(52) U.S. Cl.
CPC ..... *B41J 2/17526* (2013.01); *B41J 2/1607* (2013.01); *B41J 2/1637* (2013.01); *B41J 2/17553* (2013.01)

(58) Field of Classification Search
CPC .... B41J 2/17526; B41J 2/1607; B41J 2/1637; B41J 2/17553
See application file for complete search history.

(56) References Cited

U.S. PATENT DOCUMENTS 4,522,521 A * 6/1985 Scott ..... B41J 29/16 312/208.2
5,652,608 A * 7/1997 Watanabe ..... B41J 2/17553 347/50
6,394,580 B1 5/2002 Scheffelin et al.
(Continued)

FOREIGN PATENT DOCUMENTS

JP 60-204346 A 10/1985
TW 200528293 A 9/2005
(Continued)

*Primary Examiner* — Jason S Uhlenhake
(74) *Attorney, Agent, or Firm* — Foley & Lardner LLP

(57) ABSTRACT

In one example in accordance with the present disclosure, a fluidic die assembly is described. The fluidic die assembly includes a rigid substrate having a bend therein. A fluidic die is disposed on the rigid substrate. The fluidic die is to eject fluid from a reservoir fluidly coupled to the fluidic die. The fluidic die includes an array of ejection subassemblies. Each ejection subassembly includes an ejection chamber to hold a volume of fluid, an opening, and a fluid actuator to eject a portion of the volume of fluid through the opening. The fluidic die assembly also includes an electrical interface disposed on the rigid substrate to establish an electrical connection between the fluidic die and a controller. The fluidic die and the electrical interface are disposed on a same surface on opposite sides of the bend.

20 Claims, 11 Drawing Sheets

(56) References Cited

U.S. PATENT DOCUMENTS

| | | | | |
|---|---|---|---|---|
| 7,862,147 | B2 | 1/2011 | Ciminelli et al. | |
| 8,226,212 | B2 | 7/2012 | Swier et al. | |
| 8,496,317 | B2 | 7/2013 | Ciminelli et al. | |
| 8,517,514 | B2 | 8/2013 | Dietl | |
| 8,690,296 | B2 | 4/2014 | Ciminelli et al. | |
| 8,702,200 | B2 | 4/2014 | Choy | |
| 2003/0122897 | A1 | 7/2003 | Chou et al. | |
| 2004/0183859 | A1* | 9/2004 | Ito | B41J 2/14209 347/50 |
| 2006/0114297 | A1* | 6/2006 | Bertelsen | B41J 2/1753 347/85 |
| 2009/0040250 | A1 | 2/2009 | Suzuki | |
| 2010/0259575 | A1 | 10/2010 | Uptergrove | |
| 2011/0285767 | A1 | 11/2011 | Tanaka et al. | |
| 2012/0212540 | A1* | 8/2012 | Dietl | B41J 2/2125 347/85 |
| 2016/0257117 | A1* | 9/2016 | Chen | B41J 2/1623 |
| 2017/0190174 | A1 | 7/2017 | Dodd et al. | |
| 2018/0290158 | A1 | 10/2018 | Gruenbacher et al. | |

FOREIGN PATENT DOCUMENTS

| | | | |
|---|---|---|---|
| TW | 200918331 | A | 5/2009 |
| TW | 200940345 | A | 10/2009 |
| WO | 2013/105968 | A2 | 7/2013 |

* cited by examiner

FLUIDIC DIE ASSEMBLIES WITH RIGID BENT SUBSTRATES

BACKGROUND

A fluidic die is a component of a fluidic system. The fluidic die includes components that manipulate fluid flowing through the system. For example, a fluidic die includes a number of ejection subassemblies that eject fluid onto a surface. Through these ejection subassemblies, fluid, such as ink and fusing agent among others, is ejected or moved.

BRIEF DESCRIPTION OF THE DRAWINGS

The accompanying drawings illustrate various examples of the principles described herein and are part of the specification. The illustrated examples are given merely for illustration, and do not limit the scope of the claims.

Figure 1:
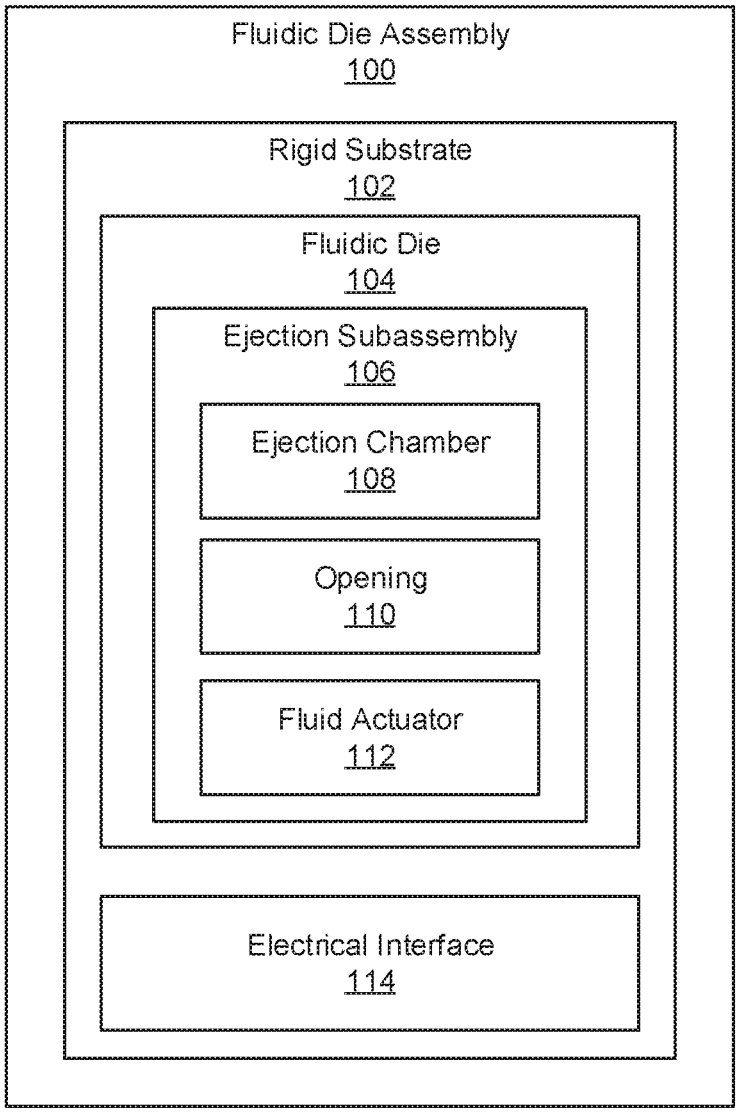
FIG. 1 is a block diagram of a fluidic die assembly with a rigid bent substrate, according to an example of the principles described herein.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

As described above, print devices in general dispense print fluid such as ink onto a surface in the form of images, text, or other patterns. The ink may be held in a reservoir, such as a replaceable cartridge. The fluid in the reservoir is passed to a fluidic die that contains ejection subassemblies. Each ejection subassembly includes components that manipulate fluid to be ejected. Through these ejection subassemblies, fluid, such as ink and fusing agent among others, is ejected or moved.

These fluidic systems are found in any number of print devices such as inkjet printers, multi-function printers (MFPs), and additive manufacturing apparatuses. The fluidic systems in these devices are used for precisely, and rapidly, dispensing small quantities of fluid. For example, in an additive manufacturing apparatus, the fluid ejection system dispenses fusing agent. The fusing agent is deposited on a build material, which fusing agent facilitates the hardening of build material to form a three-dimensional product.

Other fluid systems dispense ink on a two-dimensional print medium such as paper. For example, during inkjet printing, fluid is directed to a fluid ejection die. Depending on the content to be printed, the device in which the fluid ejection system is disposed determines the time and position at which the ink drops are to be released/ejected onto the print medium. In this way, the fluid ejection die releases multiple ink drops over a predefined area to produce a representation of the image content to be printed. Besides paper, other forms of print media may also be used.

Accordingly, as has been described, the systems and methods described herein may be implemented in a two-dimensional printing, i.e., depositing fluid on a substrate, and in three-dimensional printing, i.e., depositing a fusing agent or other functional agent on a material base to form a three-dimensional printed product. Such fluidic dies may be found in other devices such as digital titration devices and/or other such devices with which volumes of fluid may be selectively and controllably ejected.

Each fluidic die includes a fluid actuator to eject/move fluid. In a fluidic ejection die, a fluid actuator may be disposed in an ejection chamber, which chamber has an opening. The fluid actuator in this case may be referred to as an ejector that, upon actuation, causes ejection of a fluid drop via the opening.

Examples of fluid actuators include a piezoelectric membrane based actuator, a thermal resistor based actuator, an electrostatic membrane actuator, a mechanical/impact driven membrane actuator, a magneto-strictive drive actuator, or other such elements that may cause displacement of fluid responsive to electrical actuation. A fluidic die may include a plurality of fluid actuators, which may be referred to as an array of fluid actuators.

While such fluidic die have undoubtedly advanced the field of precise fluid delivery, some conditions affect their effectiveness. For example, the fluidic dies are disposed on a carrier which couples the fluidic die to the print device cartridge on which they are ultimately disposed. Limitations on the manufacturing of these carriers may limit the development of the fluidic die. For example, in some examples, fluid die are gang-bonded to the carrier. However, gang-bonding is becoming outdated and cannot be used when small fluidic die are formed. That is, as fluidic dies become smaller and smaller, the attachment of the fluidic die to a carrier becomes more difficult and may not be possible via gang-bonding.

Moreover, the materials previously used for the carrier may be susceptible to degradation via the ink that passes there through. That is, the carrier of the fluidic die is exposed to ink for extended periods of time and the chemical properties of the ink may, over time, deteriorate the carrier surface.

Accordingly, the present specification describes a fluidic die assembly that resolves these and other issues. Specifically, the fluidic die assembly includes a rigid substrate. The fluidic die and the electrical interface through which the fluidic die and the print device communicate, are both disposed on the rigid substrate. The rigid substrate is bent 90 degrees with the fluidic die on one surface and the electrical interface on the other.

Specifically, the present specification describes a fluidic die assembly. The fluidic die assembly includes a rigid substrate having a bend therein. The fluidic die assembly also includes a fluidic die disposed on the rigid substrate. The fluidic die ejects fluid from a reservoir fluidly coupled to the fluidic die. The fluidic die includes an array of ejection subassemblies, each ejection subassembly includes 1) an ejection chamber to hold a volume of fluid, 2) an opening, and 3) a fluid actuator to eject a portion of the volume of fluid through the opening. The fluidic die assembly also includes an electrical interface disposed on the rigid substrate to establish an electrical connection between the fluidic die and a controller. The fluidic die and the electrical interface are disposed on a same surface on opposite sides of the bend.

The present specification also describes a method for forming such a fluidic die assembly. According to the method, a fluidic die having an array of ejection subassemblies is joined to a rigid substrate. The rigid substrate includes an electrical interface to establish an electrical connection between the fluidic die and a print device in which the fluidic die is inserted. The electrical connection is formed between the fluidic die and the electrical interface and a bend is formed in the rigid substrate between the fluidic die and the electrical interface.

The present specification also describes a print device cartridge. The print device cartridge includes a housing and a reservoir disposed within the housing to contain a printing fluid. The print device cartridge also includes a fluidic die assembly disposed on two surfaces of the housing. The fluidic die assembly includes a rigid insert molded lead frame having a uniform thickness and an orthogonal bend therein and a fluidic die disposed on the rigid insert molded lead frame. The fluidic die ejects fluid from the reservoir fluidly coupled to the fluidic die. The fluidic die includes an array of ejection subassemblies. An electrical interface of the fluidic die includes an electrical interface disposed on the rigid insert molded lead frame to establish an electrical connection between the fluidic die and a controller. The fluidic die assembly also includes a number of fluid channels disposed through the rigid insert molded lead frame to direct the printing fluid from the reservoir to the fluidic die. In this example, the fluidic die and the electrical interface are disposed on a same surface on opposite sides of the bend.

In summary, such a fluidic die assembly 1) provides a carrier for a fluidic die that avoids ink compatibility issues, 2) facilitates use of smaller fluidic die, 3) can be manufactured at lower cost and lower complexity, and 4) can be manufactured in a batch operation.

As used in the present specification and in the appended claims, the term "print device cartridge" may refer to a device used in the ejection of ink, or other fluid, onto a print medium. In general, a print device cartridge may be a fluidic ejection device that dispenses fluid such as ink, wax, polymers, or other fluids.

Accordingly, as used in the present specification and in the appended claims, the term "print device" is meant to be understood broadly as any device capable of selectively placing a fluid onto a print medium. In one example the print device is an inkjet printer. In another example, the print device is a three-dimensional printer. In yet another example, the print device is a digital titration device.

Still further, as used in the present specification and in the appended claims, the term "print medium" is meant to be understood broadly as any surface onto which a fluid ejected from an ejection subassembly of a print device cartridge may be deposited. In one example, the print medium may be paper.

Turning now to the figures, FIG. 1 is a block diagram of a fluidic die assembly (100) with a rigid bent substrate (102), according to an example of the principles described herein. As described above, a fluidic die (104) refers to a component of a print device that ejects small droplets of fluid in particular patterns onto a print medium, the ejection being controlled by a controller. The fluidic die (104) includes ejection subassemblies (106) that include components that effectuate the ejection of such fluid. That is, the controller sends signals to the fluidic die (104) to trigger sequential ejections by different of the ejection subassemblies (106) such that fluid, such as ink, is deposited on the print medium in a particular pattern.

The fluidic die (104) is disposed on a rigid substrate (102) of the fluidic die assembly (100). The rigid substrate (102) forms a carrier that is attached to a print device cartridge such that fluid from a reservoir on the print device cartridge can be expelled through the fluidic die (104). The rigid substrate (102) includes a bend therein. The fluidic die (104) is disposed on one side of the bend and an electrical interface (114) is disposed on another side of the bend. In some examples, the bend is orthogonal, such that the fluidic die (104) sits on one surface of the cartridge and the electrical interface (114) sits on an orthogonal surface of the print device cartridge. Using a rigid substrate (102) with a bend therein is simple to manufacture, and as it is a rigid structure with a certain thickness, it is robust during attachment to the print device cartridge. That is, other carriers being thin may bend, break, or tear during installation. However, due to the rigid nature and thickness of the rigid substrate (102), it holds up to the assembly operations of the print device cartridge.

The rigid substrate (102) may be formed of a variety of materials. For example, the rigid substrate (102) may be formed of a thermoplastic material. By being formed of a thermoplastic material, which is malleable in the presence of heat, the rigid substrate (102) may be bent to form the orthogonal, or L-shaped fluidic die assembly (100). In other examples, at least a portion of the rigid substrate (102) may be formed of a thermoset material. As a thermoset material does not bend in the face of applied heat energy, the portion of the rigid substrate (102) that forms the bend may have a gap in the thermoset material, which gap may or may not be filled with a thermoplastic material.

Specific examples of materials that may form the rigid substrate (102) with a bend therein include, but are not limited to, polyethylene plastic, polyethylene terephthalate plastic, polysulfone plastic, polyphenylene sulfide plastic, and a liquid crystal polymer material. While specific reference is made to a few particular materials that form the rigid substrate (102) other materials may be implemented in accordance with the principles described herein. Using a plastic rigid material rather than a flexible tape also reduces the deteriorating effect of the printing fluid. That is, these plastic-based materials do not deteriorate in the presence of the ink that passes there through.

The fluidic die assembly (100) also includes the fluidic die (104) that is disposed on the rigid substrate (102). As described above, a fluidic die (104) includes components that manipulate fluid flowing through the system. For example, a fluidic die (205) includes an array of ejection subassemblies (106) that eject fluid onto a surface. Through these ejection subassemblies (106), fluid, such as ink and fusing agent among others, is ejected or moved.

Each ejection subassembly (106) may include a number of components for depositing a fluid onto a print medium. For example, the ejection subassembly (106) may include a fluid actuator (112), an ejection chamber (108), and an opening (110). The opening (110) may allow fluid, such as ink, to be deposited onto the print medium. The ejection chamber (108) may include a small amount of fluid. The fluid actuator (112) may be a mechanism for ejecting fluid through an opening (110) of the ejection chamber (108).

The fluidic die assembly (100) also includes an electrical interface (114) that is disposed on the rigid substrate (102). As described above, the electrical interface (114) may be disposed on a same surface of the rigid substrate (102) as the fluidic die (104), but on a different side of the bend from the fluidic die (104). That is, when the fluidic die assembly (100) is placed on the print device cartridge, the fluidic die (104) and the electrical interface (114) may be orthogonal to one another.

The electrical interface (114) establishes an electrical connection between the fluidic die (104) and the controller. That is, as described above, a controller sends electrical pulses which activates the ejection subassemblies (106) of the fluidic die (104) to activate at different times corresponding to a desired printing fluid pattern to be deposited on the print target. These electrical pulses are received at the fluidic die assembly (100) through the electrical interface (114) pads.

Figure 2A:
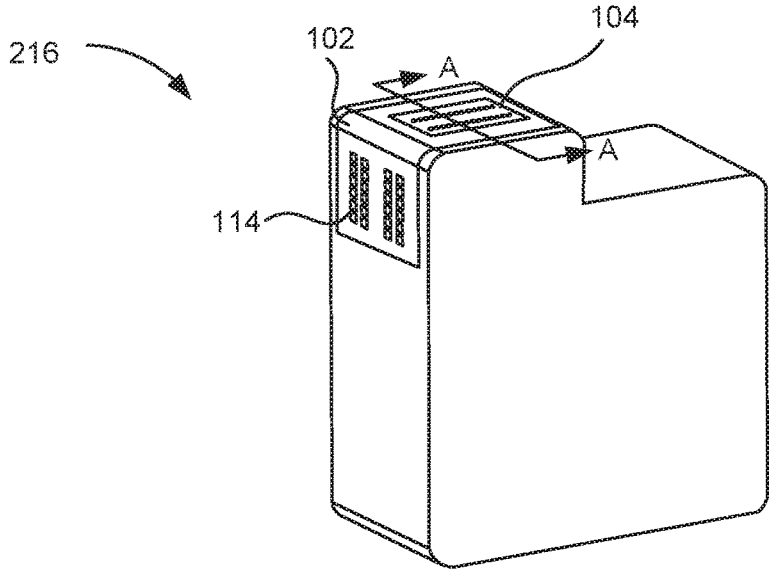
FIGS. 2A-2C are isometric views of a print device cartridge with a fluidic die assembly with a rigid bent substrate, according to an example of the principles described herein.
Figure 2B:
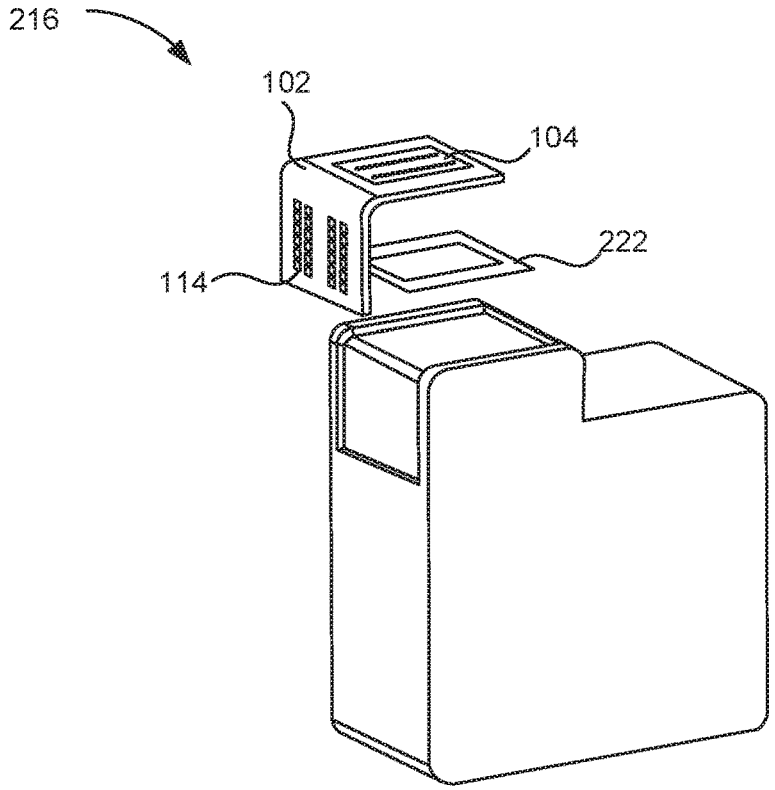
Figure 2C:
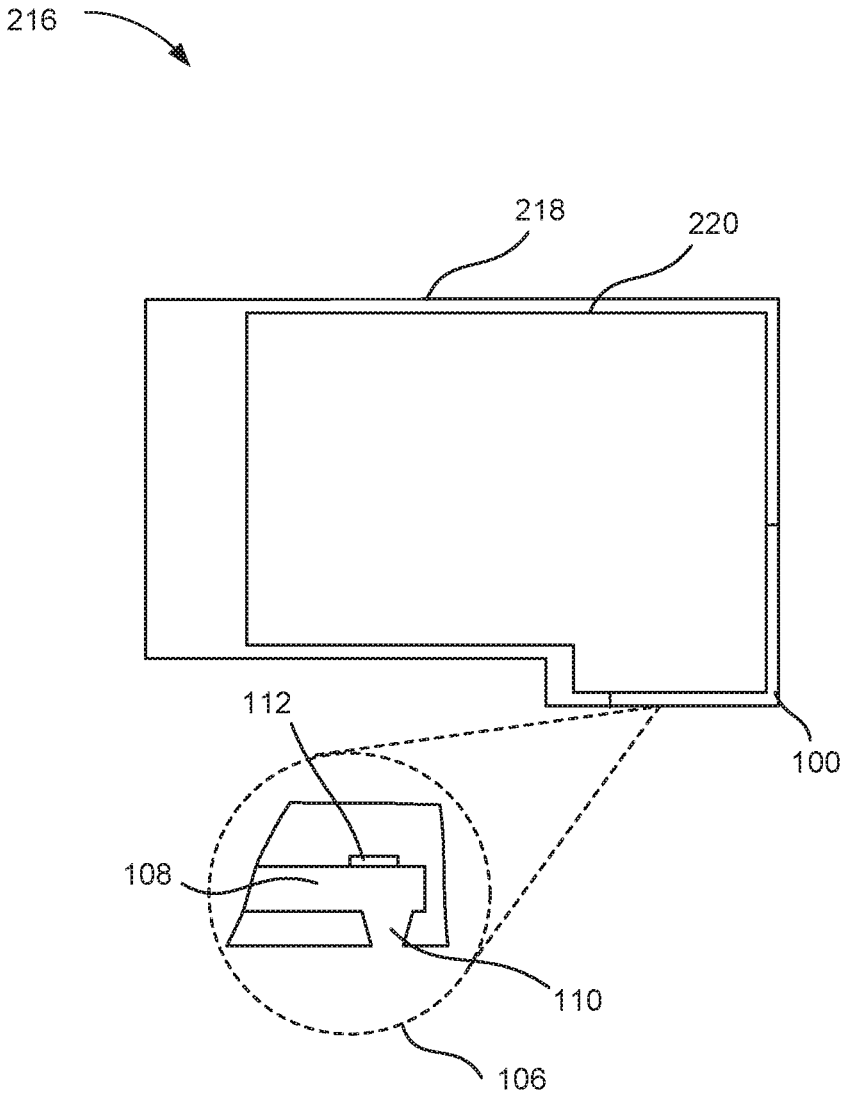

FIGS. 2A-2C are isometric views of a print device cartridge (216) with a fluidic die assembly (100) with a rigid bent substrate (102), according to an example of the principles described herein. Specifically, FIG. 2A is an assembled view of the print device cartridge (216), FIG. 2B is an exploded view of the print device cartridge (216), and FIG. 2C is a cross-sectional view of the print device cartridge (216). In some examples, the print device cartridge (216) may be removable from the print device, for example as a replaceable cartridge (216).

The print device cartridge (216) includes a fluidic die assembly (100) that ejects drops of fluid through a plurality of ejection subassemblies (106) towards a print medium. The print medium may be any type of suitable sheet or roll material, such as paper, card stock, transparencies, polyester, plywood, foam board, fabric, canvas, and the like. In another example, the print medium may be a bed of powder material used in three-dimensional printing.

Ejection subassemblies (106) may be arranged in columns or arrays such that properly sequenced ejection of fluid from the ejection subassemblies (106) causes characters, symbols, and/or other graphics or images to be printed on the print medium as the fluidic die assembly (100) and print medium are moved relative to each other. In one example, the number of ejection subassemblies (106) fired may be a number less than the total number of ejection subassemblies (106) available and defined on the fluidic die assembly (100).

The print device cartridge (216) also includes a fluid reservoir (220) to supply an amount of fluid to the fluidic die assembly (100). In general, fluid flows between the reservoir (220) and the fluidic die assembly (100). In some examples, a portion of the fluid supplied to fluidic die assembly (100) is consumed during operation and fluid not consumed during printing is returned to the reservoir (220). The fluid reservoir (220) is contained, or defined by, the housing (218) of the print device cartridge (216). It is upon this same housing (218) that the fluidic die assembly (100) is adhered.

As described above, the fluidic die assembly (100) includes a rigid substrate (102). In one example, the rigid substrate (102) is a rigid insert molded lead frame. That is, the electrical leads that electrically connect the fluidic die (104) to the electrical interface (114) may be insert molded into the substrate (102). For example, trace wires may be positioned inside a mold. Following their insertion, a material in liquid or semi-liquid form may be poured into the mold encapsulating the electrical connections, or electrical leads therein. As depicted in FIGS. 2A and 2B, the rigid substrate (102) may have an orthogonal bend and uniform thickness. The degree of the bend may be determined based on a particular application. For example, a housing (218) may have right angles and the bend may therefore also be a right angle. The uniform thickness of the rigid plastic substrate (102) provides robustness against mechanical damage that may result from the handling of the fluidic die assembly (100) during manufacturing, shipping, and/or operation.

The print device cartridge (216) may be installed into a cradle of a print device. When the print device cartridge (216) is correctly installed into the print device, the electrical interface (114) pads are pressed against corresponding electrical contacts in the cradle, allowing the print device to communicate with, and control the electrical functions of, the print device cartridge (216). For example, the electrical interface (114) allows the print device to control the sequenced activation of different fluid actuators (112). That is, to eject fluid, the print device moves the carriage containing the print device cartridge (216) relative to a print medium. At appropriate times, the print device sends electrical signals to the print device cartridge (216) via the electrical contacts in the cradle. The electrical signals pass through the electrical interface (114) and are routed through the rigid substrate (102) to the fluidic die (104). The fluidic die (104) then ejects a small droplet of fluid from the reservoir (220) onto the surface of the print medium.

FIG. 2B is an exploded view of the print device cartridge (216) that illustrates another component of the print device cartridge (216). In this example, the print device cartridge (216) includes an adhesive (222) that joins the fluidic die assembly (100) to the rigid substrate (102).

FIG. 2C is a cross sectional diagram of a print device cartridge (216) and fluidic die assembly (100). As described above, the print device cartridge (216) includes a reservoir (220) disposed within a housing (218), the reservoir (220) to supply the fluid to the fluidic die assembly (100) for deposition onto a print medium. In some examples, the fluid may be ink. For example, the print device cartridge (216) may be an inkjet printer cartridge, the fluidic die assembly (100) may be an inkjet fluidic die assembly (100), and the ink may be inkjet ink.

FIG. 2C also highlights the elements of the ejection subassembly (106) that carry out at least a part of the functionality of depositing fluid onto a print medium. That is, FIG. 2C depicts the fluid actuator (112), ejection chamber (108), and opening (110). As described above, the fluid actuator (112) may be a mechanism for ejecting fluid through the opening (110) of the ejection chamber (FIG. 1, 108). The fluid actuator (112) may include a firing resistor or other thermal device, a piezoelectric element, or other mechanism for ejecting fluid from the ejection chamber (108).

For example, the fluid actuator (112) may be a firing resistor. The firing resistor heats up in response to an applied voltage. As the firing resistor heats up, a portion of the fluid in the ejection chamber (108) vaporizes to form a bubble. This bubble pushes liquid fluid out the opening (110) and onto the print medium. As the vaporized fluid bubble pops, a vacuum pressure within the ejection chamber (108) draws fluid into the ejection chamber (108) from the reservoir (220), and the process repeats. In this example, the fluidic die assembly (100) may be a thermal inkjet fluidic die assembly (100).

In another example, the fluid actuator (112) may be a piezoelectric device. As a voltage is applied, the piezoelectric device changes shape which generates a pressure pulse in the ejection chamber (108) that pushes a fluid out the opening (110) and onto the print medium. In this example, the fluidic die assembly (110) may be a piezoelectric inkjet fluidic die assembly (100).

Figure 3:
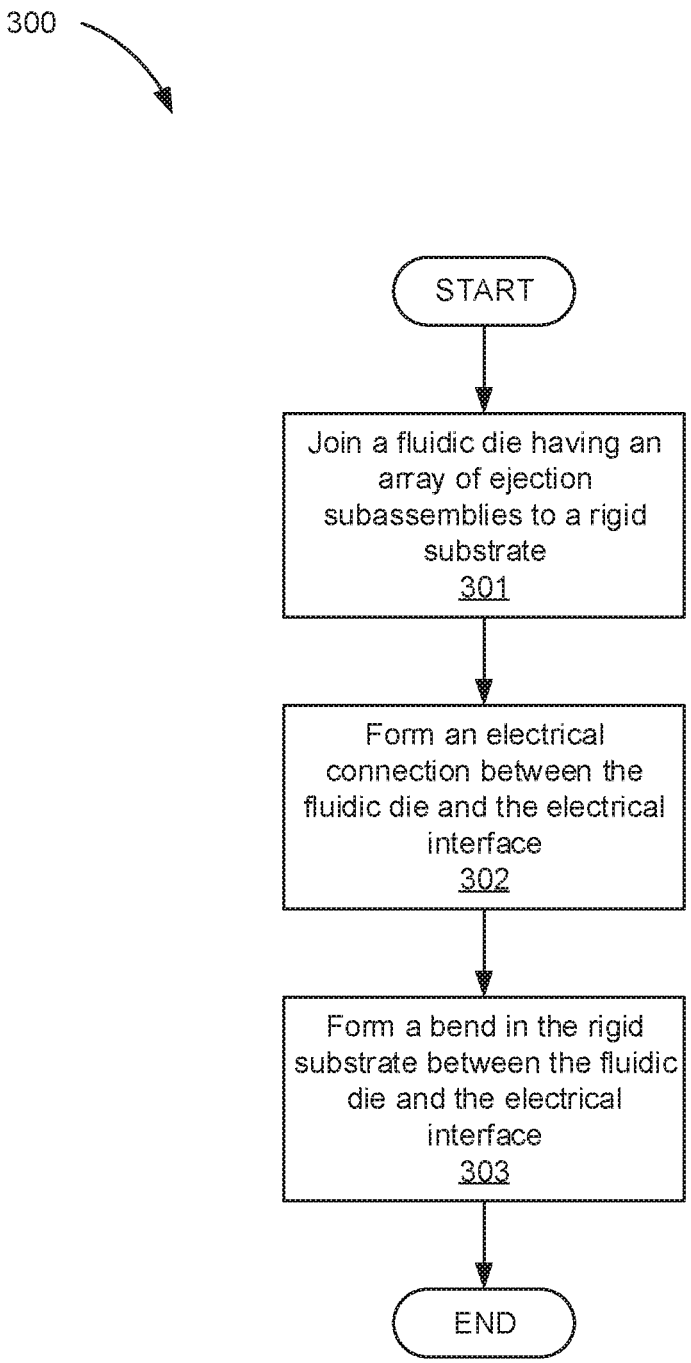
FIG. 3 is a flowchart of a method for forming a fluidic die assembly with a rigid bent substrate, according to an example of the principles described herein.

FIG. 3 is a flowchart of a method (300) for forming a fluidic die assembly (FIG. 1, 100) with a rigid bent substrate (FIG. 1, 102), according to an example of the principles described herein. According to the method (300), a fluidic die (FIG. 1, 104) having an array of ejection subassemblies (FIG. 1, 106) is joined (block 301) to a rigid substrate (FIG. 1, 102). This may be done in any number of ways. For example, in some cases the rigid substrate (FIG. 1, 102) includes a pocket into which the fluidic die (FIG. 1, 104) is to be inserted. In this example, the fluidic die (FIG. 1, 104), either as an isolated component or along with an overmold structure, may receive an adhesive and may be placed into the pocket. In another example, the fluidic die (FIG. 1, 104) is placed, opening (FIG. 1, 112) down, on a substrate, and a liquid or semi-liquid material that forms the rigid substrate (FIG. 1, 102) may be poured over the fluidic die (FIG. 1, 104). In yet another example, the fluidic die (FIG. 1, 104) may be placed in a mold and a liquid or semi-liquid material is poured into the mold such that when the liquid or semi-liquid material hardens it forms the rigid substrate (FIG. 1, 102) with the fluidic die (FIG. 1, 104) disposed therein.

The method (300) also includes forming the electrical interfaces (FIG. 1, 114) in the rigid substrate (FIG. 1, 102). Following formation of these two components, an electrical connection is formed (block 302) between the fluidic die (FIG. 1, 104) and the electrical interface (FIG. 1, 114). In some examples, this may occur as the fluidic die (FIG. 1, 104) is joined (block 301) to the rigid substrate (FIG. 1, 102). That is, the rigid substrate (FIG. 1, 102) may include electrical traces in a pocket or other location where the fluidic die (FIG. 1, 104) is to be disposed on the rigid substrate (FIG. 1, 102). These electrical traces may lead to the location where the electrical interface (FIG. 1, 114) resides, or will reside upon installation. Accordingly, as the fluidic die (FIG. 1, 104) is joined (block 301) to the rigid substrate (FIG. 1, 102) the electrical connection is formed (block 302). In some examples, other types of electrical connections may be formed (block 302). For example, the fluidic die (FIG. 1, 104) may be wire-bonded to the electrical interface (FIG. 1, 114).

With these components joined (block 301) and the electrical connection formed (block 302), the bend in the rigid substrate (FIG. 1, 102) may be formed (block 303). That is, the bend that allows the fluidic die (FIG. 1, 104) to be positioned on one surface of the print device cartridge (FIG. 2, 216) and the electrical interface (FIG. 1, 114) to be positioned on another surface of the print device cartridge (FIG. 2, 216) is formed (block 303). This may be done in a number of ways. For example, if the material of the rigid substrate (FIG. 1, 102) allows, the material may simply be bent. In another example, a region of the rigid substrate (FIG. 1, 102) may be heated and a force may be applied to bend the rigid substrate (FIG. 1, 102). As a specific example, a heated pin may be placed on one side of the rigid substrate (FIG. 1, 102) where the bend is to be formed. The heated pin may alter the physical properties of the rigid substrate (FIG. 1, 102). Accordingly, a force may then be applied that bends the rigid substrate (FIG. 1, 102) to an angle, for example a right angle, around the heated pin. In another example, the pin may not be heated, but heat energy may be applied such that the physical properties of the rigid substrate (FIG. 1, 102) are altered and the application of force bends the rigid substrate (FIG. 1, 102) about the non-heated pin. Specific examples of the formation (block 303) of the bend are provided below in connection with FIGS. 6A-9C. While FIGS. 6A-9C depict particular examples using a pin, other methods of bending the rigid substrate (FIG. 1, 102) may be implemented which may include heat application and/or mechanical bending.

Figure 4:
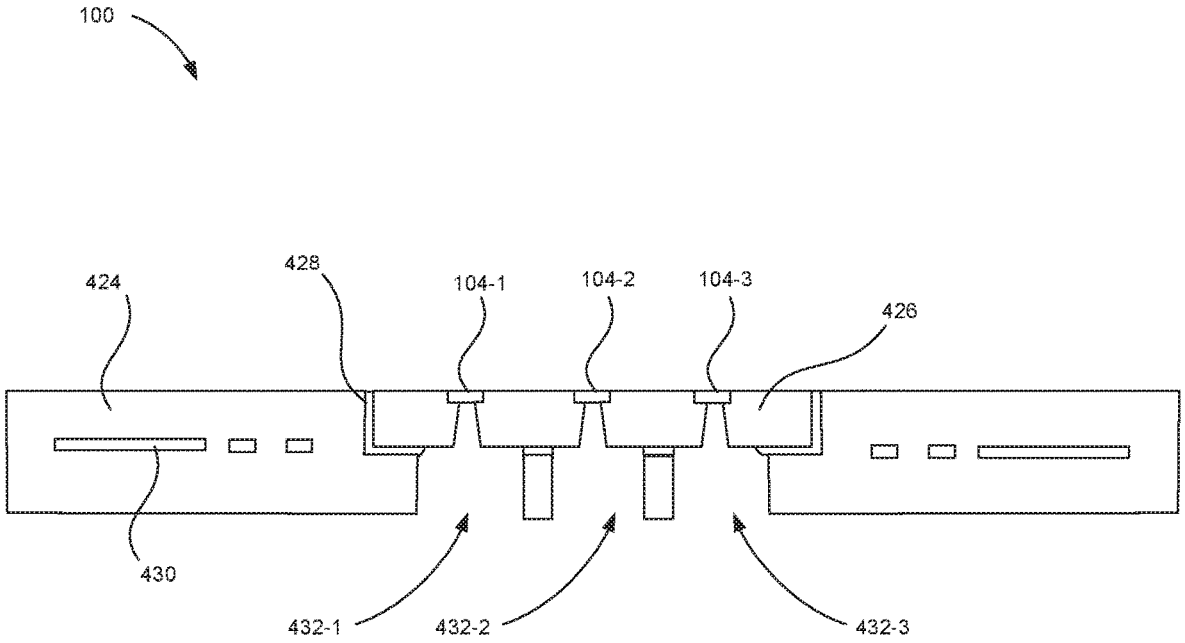
FIG. 4 is a cross-sectional view of a fluidic die assembly with a rigid bent substrate, according to an example of the principles described herein.

FIG. 4 is a cross-sectional view of a fluidic die assembly (100) with a rigid bent substrate (FIG. 1, 102), according to an example of the principles described herein. Specifically, FIG. 4 is a cross-sectional view taken along the line A-A from FIG. 2A. As described above, there are many types of rigid substrate (FIG. 1, 102) that may be used. In one particular example, the rigid substrate (FIG. 1, 102) is a rigid insert molded lead frame (424). That is, the electrical leads (430) from the fluidic die (104) to the electrical interface (FIG. 1, 114) are embedded in the substrate. FIG. 4 also illustrates channels (432-1, 432-2, 432-3) that are disposed in the rigid insert molded lead frame (424) or any other rigid substrate (FIG. 1, 102) that may be used. That is, as described above, fluid travels from the reservoir (FIG. 2, 220) to the fluidic die (104) to be ejected. Accordingly, the rigid substrate (FIG. 1, 102) includes channels (432-1, 432-2, 432-3) that allow such a fluid flow.

In some examples, the fluidic die assembly (100) includes additional components. For example, the fluidic die assembly (100) may include any number of silicon fluidic die (104-1, 104-2, 104-3) that each include an array of ejection subassemblies (FIG. 1, 106). While FIG. 4 depicts three silicon sliver fluidic die (104-1, 104-2, 104-3), any type or number of fluidic die (104) may be implemented in accordance with the principles described herein. In one example, the fluidic die (104) may be bonded, or encapsulated by an overmold (426). The overmold (426) decouples the size of the fluidic die (104) with the rigid substrate (FIG. 1, 102) to which it is attached. That is, as fluidic die (104) become smaller and smaller, it is more and more difficult to position them on a substrate (FIG. 1, 102) without interfering with the operation of the ejection subassemblies (FIG. 1, 106). Accordingly, the overmold (426) allows for smaller fluidic die (104) to be used and simplifies their attachment to the rigid substrate (FIG. 1, 102) such as the rigid insert molded lead frame (424). The overmold (426) may also provide a thermal barrier between the rigid substrate (FIG. 1, 102) and the fluidic die (104). That is, to form the bend, the rigid substrate (FIG. 1, 102) is heated. This heating, if excessive and penetrating into the fluidic die (104), can damage these components. Thus, the overmold (426) allows for higher temperature range substrates to be used as it prevents the heat from transferring to, and damaging, the fluidic die (104).

In this example, the overmold (426) provides a connection interface between the rigid insert molded lead frame (424) and the fluidic die (104). For example, the overmold (426) with the fluidic die (104) disposed therein may be joined, or disposed within a pocket of the rigid substrate (FIG. 1, 102) via an adhesive layer (428).

Figure 5:
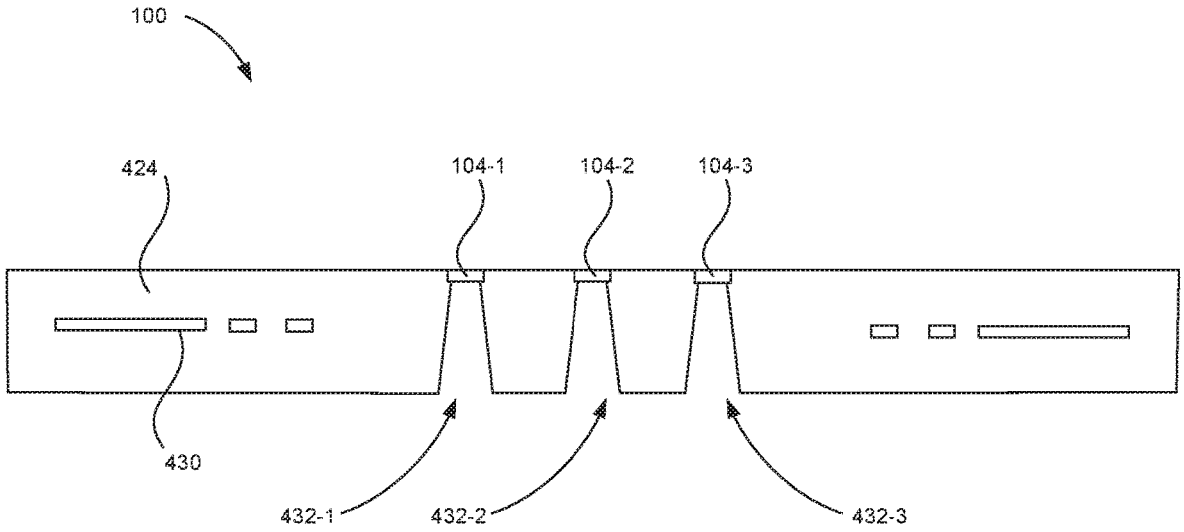
FIG. 5 is a cross-sectional view of a fluidic die assembly with a rigid bent substrate, according to an example of the principles described herein.

FIG. 5 is a cross-sectional view of a fluidic die assembly (100) with a rigid bent substrate (FIG. 1, 102), according to an example of the principles described herein. Specifically, FIG. 5 is a cross-sectional view taken along the line A-A from FIG. 2A. FIG. 5 depicts the rigid substrate (FIG. 1, 102) as a rigid insert molded lead frame (424) with electrical leads (430) embedded in the substrate. FIG. 5 also illustrates the channels (432-1, 432-2, 432-3) that are disposed in the rigid insert molded lead frame (424) or any other rigid substrate (FIG. 1, 102) that may be used.

However, in the example depicted in FIG. 5, the fluidic die (104) which may be a silicon die, is molded right into the rigid substrate (FIG. 1, 102). In some examples, the fluidic die (104) may be molded into the rigid substrate (FIG. 1, 102) at the same time as the leads (430). That is, both the leads (430) and the fluidic die (104) may be placed on a substrate or in a mold. A liquid or semi-liquid material is then poured over these components. In this example, as the material cures and/or hardens, it forms the rigid substrate (FIG. 1, 102).

Figure 6A:
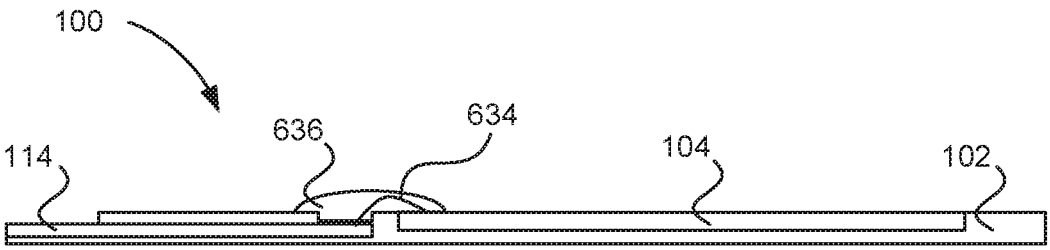
FIGS. 6A-6C are cross-sectional diagrams showing the formation of a fluidic die assembly with a rigid bent substrate, according to an example of the principles described herein.
Figure 6B:
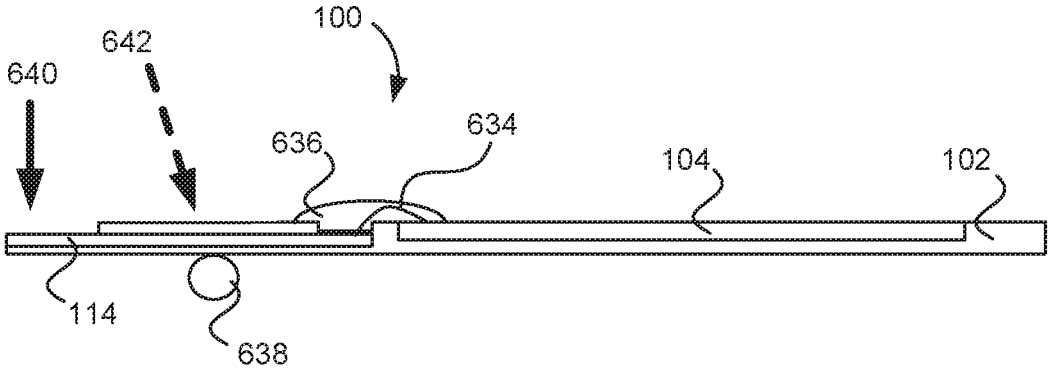
Figure 6C:
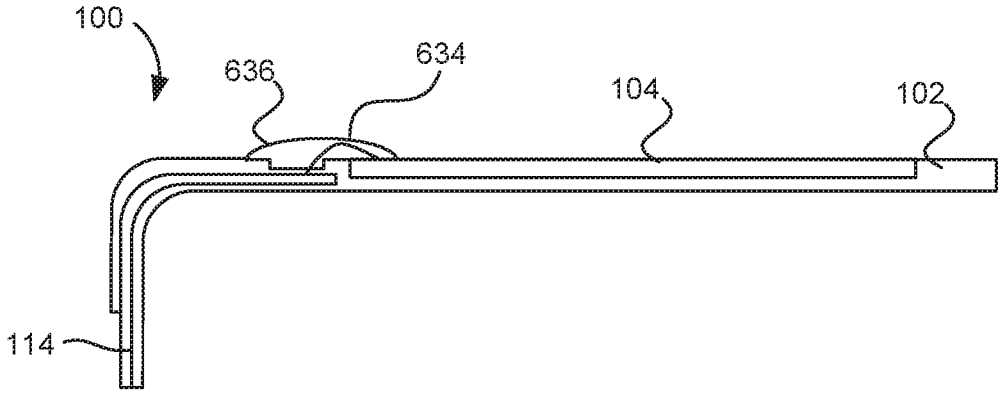

FIGS. 6A-6C are cross-sectional diagrams showing the formation of a fluidic die assembly (100) with a rigid bent substrate (102), according to an example of the principles described herein. As described above, the rigid substrate (102) may be formed of any number of materials. Different materials provide different physical properties to the fluidic die assembly (100). The material used to form the rigid substrate (102) also affects the method (FIG. 3, 300) of forming the fluidic die assembly (100). In the example depicted in FIGS. 6A-6C, the material is a thermoplastic material. As used in the present specification and in the appended claims, the term thermoplastic refers to a material that is plastically deformable in the presence of heat energy. The rigid substrate (102) may be formed of different kinds of thermoplastics such as polyethylene terephthalate (PET) and polyphenylene plastic (PPS). That is, the method (300) described above, and depicted in FIGS. 6A-6C may be implemented on plastics that bend at a low temperature, such as PET, and plastics that bend at a higher temperature, such as PPS.

FIG. 6A clearly depicts the rigid substrate (102) as well as the fluidic die (104) disposed thereon. FIG. 6A also depicts another type of electrical connection. In this example, electrical leads (634) are wire-bonded between the fluidic die (104) and the electrical interface (114). In this example, the leads (634) are covered with an encapsulant (636) to electrically insulate them and to protect them from mechanical damage.

As depicted in FIG. 6A, in some examples, a portion of the electrical interface (114) is covered while another portion is exposed. The exposed portion represents that portion that contacts electrical contacts on the carriage of the print device to establish an electrical connection with the controller on the print device.

As depicted in FIG. 6B, a pin (638) may be used to form the bend. In some examples, the pin (638) may be heated. The heat from the pin (638) may alter the properties of the thermoplastic rigid substrate (102) such that it may be bent. Accordingly, a force may be applied in the direction indicated by the arrow (640). The application of this force bends the rigid substrate (102) such that a bent fluidic die assembly (100) may be formed as depicted in FIG. 6C.

In another example, the pin (638) is not a heated pin (638). In this example, heat may be applied to a surface where the bend is to be formed as indicated by the dashed arrow (642). In this case as well, the heat (638) may alter the properties of the thermoplastic such that it may be bent around the pin (638). Accordingly, a force may be applied in the direction indicated by the arrow (640). The application of this force bends the rigid substrate (102) such that a bent fluidic die assembly (100) may be formed as depicted in FIG. 6C. As described above, while FIGS. 6A-6C depict the use of a heated or non-heated pin (638) other methods of forming the bend may be implemented which may include heat application and/or mechanical force.

Figure 7A:
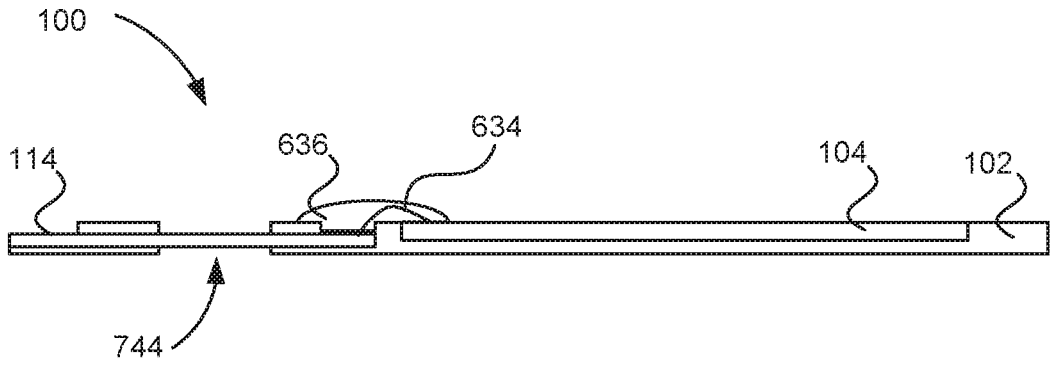
FIGS. 7A-7C are cross-sectional diagrams showing the formation of a fluidic die assembly with a rigid bent substrate, according to another example of the principles described herein.
Figure 7B:
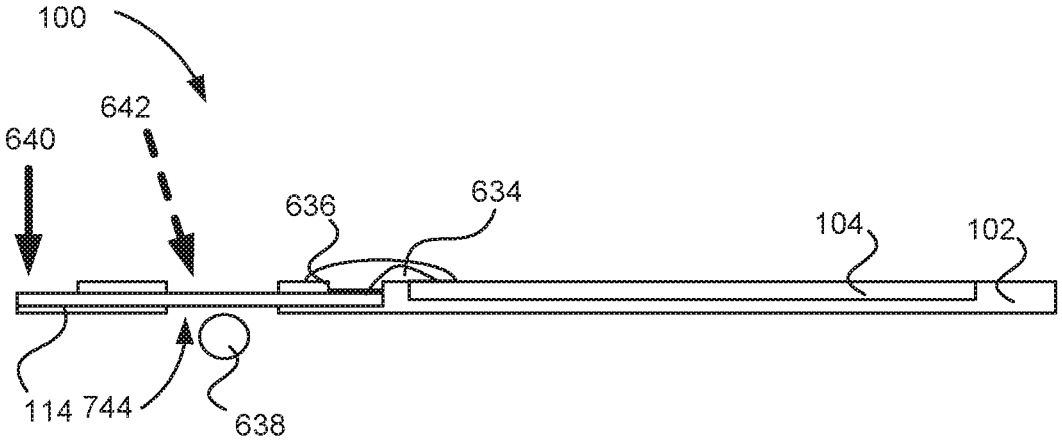
Figure 7C:
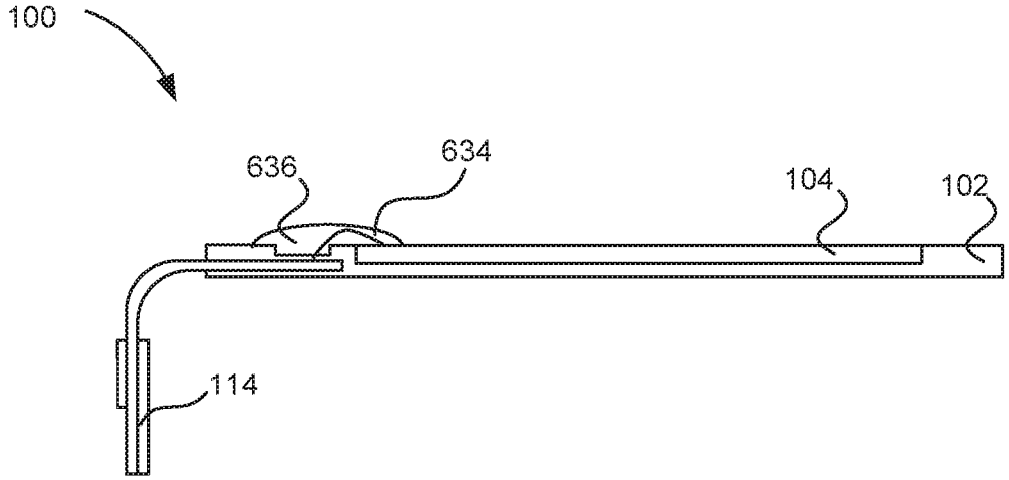

FIGS. 7A-7C are cross-sectional diagrams showing the formation of a fluidic die assembly (100) with a rigid bent substrate (102), according to another example of the principles described herein. In this example, the rigid substrate (102) is formed of a thermoset material. A thermoset material does not plastically deform in the presence of heat energy. Accordingly, a fluidic die assembly (100) formed of a thermoset material may be more physically robust and less prone to breaking during manufacture, assembly, shipping, and/or use. Examples of a thermoset material include, but are not limited to an epoxy mold compound (EMC).

FIG. 7A clearly depicts the rigid substrate (102) as well as the fluidic die (104) disposed thereon. FIG. 7A also depicts the electrical leads (634) that are wire-bonded between the fluidic die (104) and the electrical interface (114) and the encapsulant (636) to electrically insulate them and to protect them from mechanical damage.

As depicted in FIG. 7A, in some examples, a portion of the electrical interface (114) is covered while another portion is exposed. The exposed portion represents that portion that contacts electrical contacts on the carriage of the print device to establish an electrical connection with the controller on the print device.

As the thermoset material does not bend, the rigid substrate (102) includes a gap (744) at the location of the rigid substrate (102) that is to be bent. The material that makes up the electrical interface (114) which may be copper, gold, or other conductive material is more deformable than the thermoset material and therefore provides the deformation to form the bend.

Accordingly, as described above, a pin (638) may be used to form the bend as depicted in FIG. 7B. Also as described above, the pin (638) may be heated and/or the heat may be applied separately as indicated by the arrow (642). In examples where there is a gap (744), no heat may be applied. That is, the electrical interface (114) material may be malleable enough that the bend can be formed without any application of heat energy.

In any case, a force may be applied in the direction indicated by the arrow (640). The application of this force bends the rigid substrate (102) such that a bent fluidic die assembly (100) may be formed as depicted in FIG. 7C. As described above, while FIGS. 7A-7C depict the use of a heated or non-heated pin (638) other methods of forming the bend may be implemented which may include heat application and/or mechanical force.

Figure 8A:
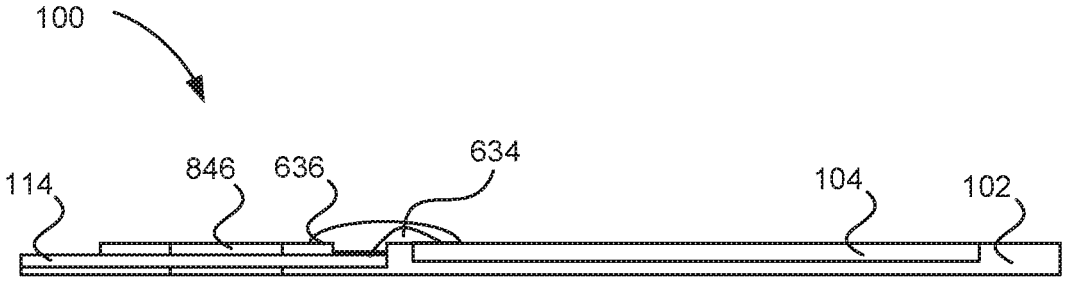
FIGS. 8A-8C are cross-sectional diagrams showing the formation of a fluidic die assembly with a rigid bent substrate, according to another example of the principles described herein.
Figure 8B:
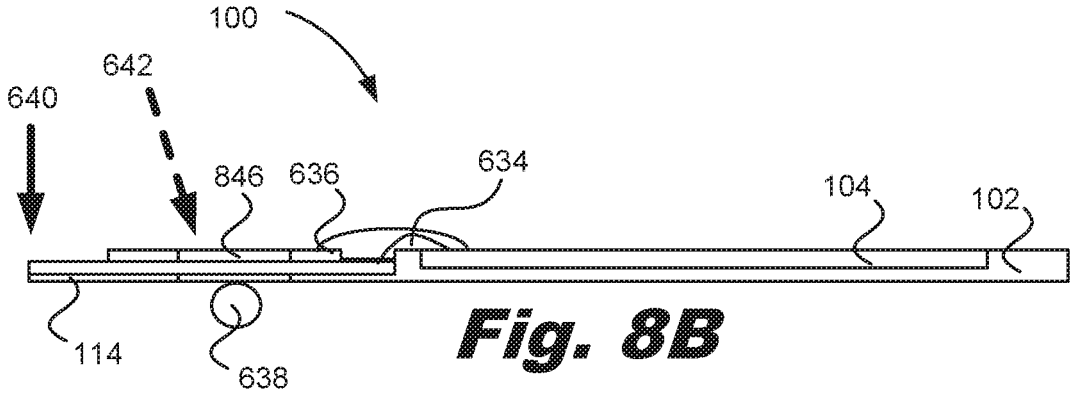
Figure 8C:
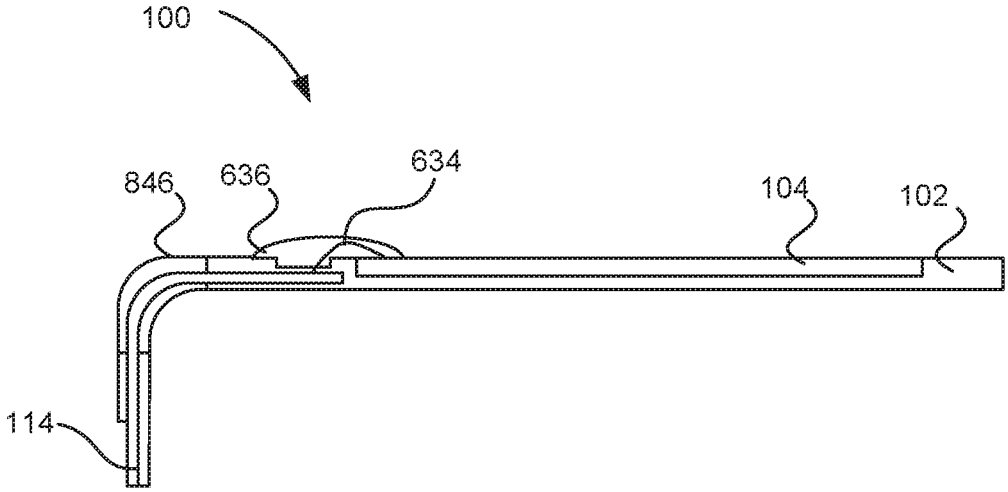

FIGS. 8A-8C are cross-sectional diagrams showing the formation of a fluidic die assembly (100) with a rigid bent substrate (102), according to another example of the principles described herein. In the example depicted in FIGS. 8A-8C, the rigid substrate (102) is formed of a thermoset material. However, in this example rather than having a gap (FIG. 7, 744), the rigid substrate (102) includes a thermoplastic region (846) at the location of the bend. Doing so provides for the rigidity provided by the thermoset material, but still allows a bend to form, while keeping the electrical interface (114) material protected from mechanical damage.

FIG. 8A clearly depicts the rigid substrate (102) as well as the fluidic die (104) disposed thereon. FIG. 8A also depicts the electrical leads (634) that are wire-bonded between the fluidic die (104) and the electrical interface (114) and the encapsulant (636) to electrically insulate them and to protect them from mechanical damage.

As depicted in FIG. 8A, in some examples, a portion of the electrical interface (114) is covered while another portion is exposed. The exposed portion represents that portion that contacts electrical contacts on the carriage of the print device to establish an electrical connection with the controller on the print device.

As described above, a pin (638) may be used to form the bend as depicted in FIG. 8B. Also as described above, the pin (638) may be heated and/or the heat may be applied separately as indicated by the arrow (642). A force may be applied in the direction indicated by the arrow (640). The application of this force bends the rigid substrate (102) such that a bent fluidic die assembly (100) may be formed as depicted in FIG. 8C. As described above, while FIGS. 8A-8C depict the use of a heated or non-heated pin (638) other methods of forming the bend may be implemented which may include heat application and/or mechanical force.

Figure 9A:
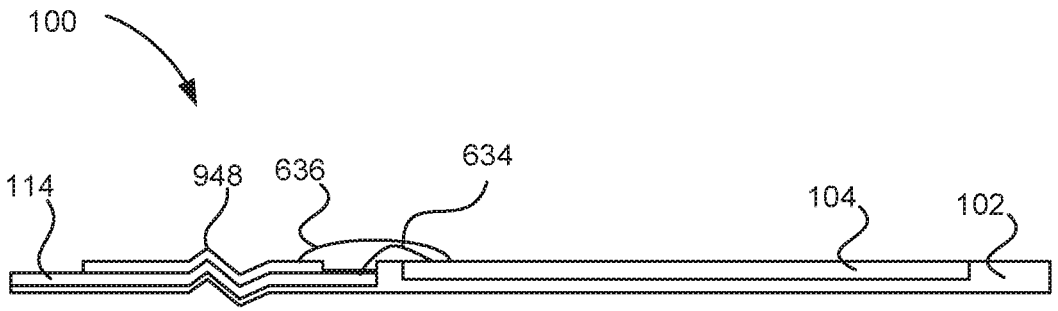
FIGS. 9A-9C are cross-sectional diagrams showing the formation of a fluidic die assembly with a rigid bent substrate, according to another example of the principles described herein.
Figure 9B:
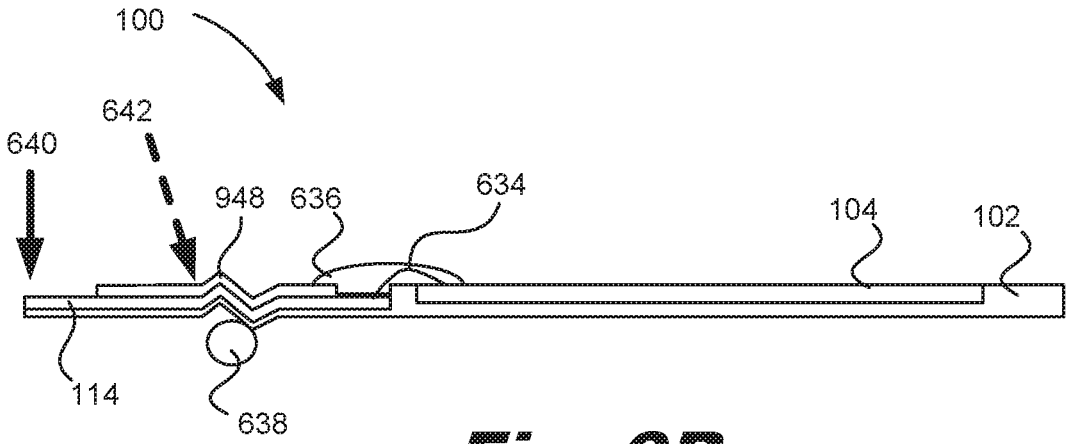
Figure 9C:
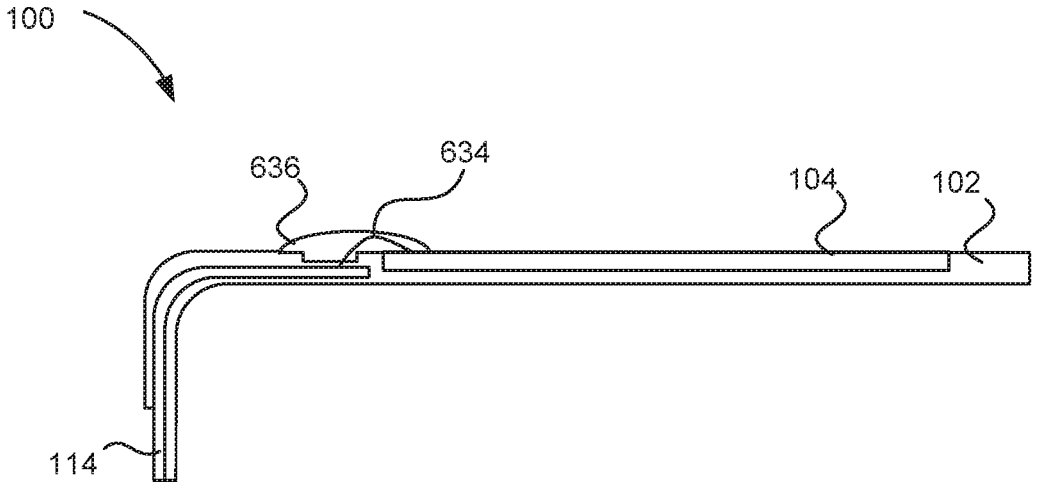

FIGS. 9A-9C are cross-sectional diagrams showing the formation of a fluidic die assembly (100) with a rigid bent substrate (102), according to another example of the principles described herein. In the example depicted in FIGS. 9A-9C, the rigid substrate (102) is formed of a thermoplastic material. In this example, the rigid substrate (102) includes a relief structure (948) disposed at the location of the bend. Such a relief structure (948) aids in the formation of the bend. For example, without such a relief structure (948) the application of the force may stretch, thin, or otherwise undesirably deform the rigid substrate (102) and/or electrical interface (114) material. Accordingly, the relief structure (948) allows for control over the formation of the bend.

FIG. 9A clearly depicts the rigid substrate (102) as well as the fluidic die (104) disposed thereon. FIG. 9A also depicts the electrical leads (634) that are wire-bonded between the fluidic die (104) and the electrical interface (114) and the encapsulant (636) to electrically insulate them and to protect them from mechanical damage.

As depicted in FIG. 9A, in some examples, a portion of the electrical interface (114) is covered while another portion is exposed. The exposed portion represents that portion that contacts electrical contacts on the carriage of the print device to establish an electrical connection with the controller on the print device.

As described above, a pin (638) may be used to form the bend as depicted in FIG. 9B. Also as described above, the pin (638) may be heated and/or the heat may be applied separately as indicated by the arrow (642). A force may be applied in the direction indicated by the arrow (640). The application of this force bends the rigid substrate (102) such that a bent fluidic die assembly (100) may be formed as depicted in FIG. 9C. While FIGS. 9A-9C depict the use of a relief structure (948) on a material entirely formed of a thermoplastic material, the same relief structure (948) could be implemented on an example where a thermoset material is used with a thermoplastic region (FIG. 8, 846) as described above in connection with FIGS. 8A-8C. As described above, while FIGS. 9A-9C depict the use of a heated or non-heated pin (638) other methods of forming the bend may be implemented which may include heat application and/or mechanical force.

Figure 10:
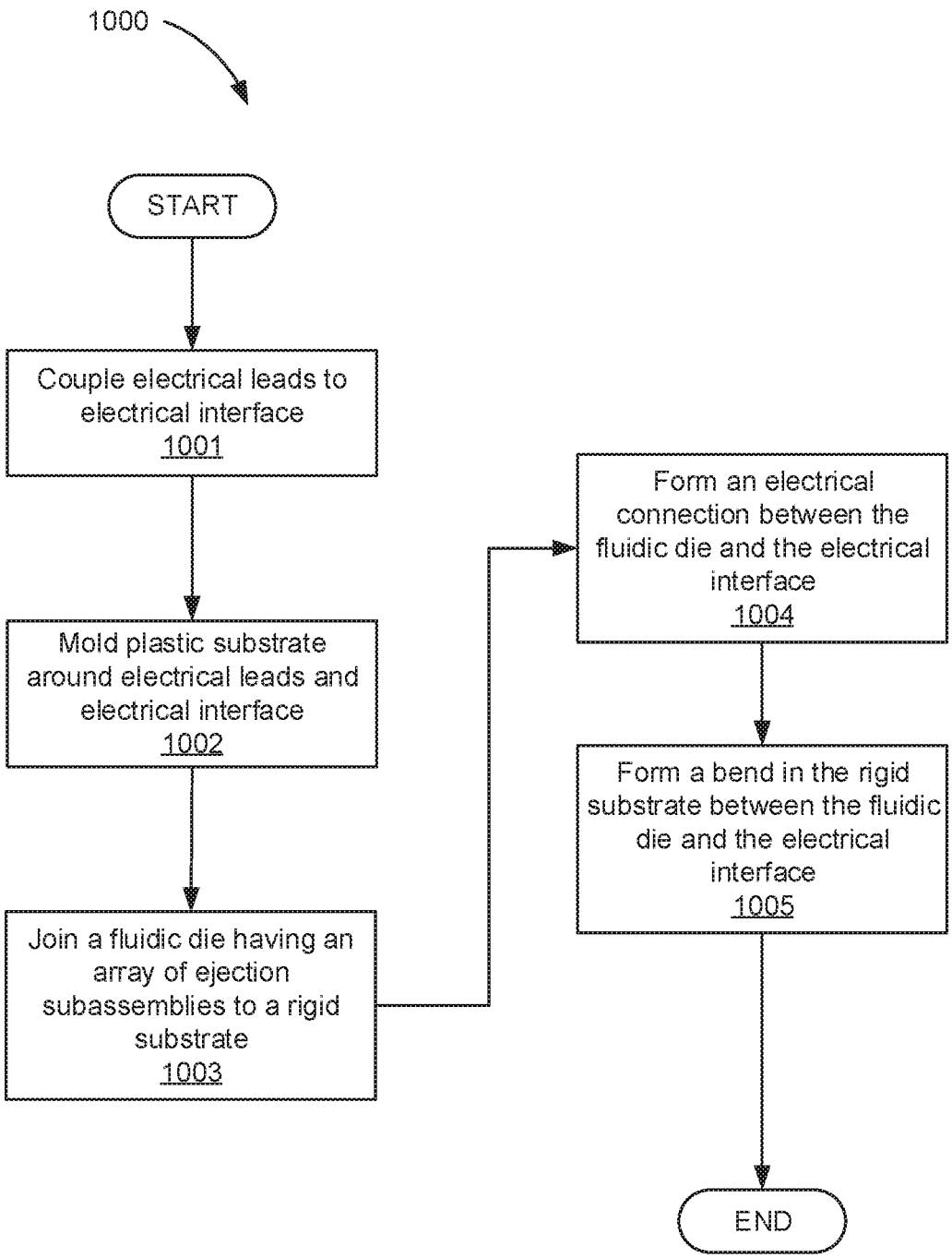
FIG. 10 is a flowchart of a method for forming a fluidic die assembly with a rigid bent substrate, according to another example of the principles described herein.

FIG. 10 is a flowchart of a method (100) for forming a fluidic die assembly (FIG. 1, 100) with a rigid bent substrate (FIG. 1, 102), according to another example of the principles described herein. In the specific example described herein, the rigid substrate (FIG. 1, 102) is the rigid insert molded lead frame (FIG. 4, 424). In this example, the method (1000) includes coupling (block 1001) the electrical leads (FIG. 4, 430) to the electrical interface (FIG. 1, 114). That is, the electrical leads (FIG. 4, 430) may be electrically coupled, for example via a bonding operation, to the electrical interface (FIG. 1, 114). A plastic substrate is then molded (block 1002) around the electrical leads (FIG. 4, 430) and the electrical interface (FIG. 1, 114). For example, the electrical leads (FIG. 4, 430) and electrical interface (FIG. 1, 114) that are coupled together may be placed in a mold and a liquid or semi-liquid plastic material may be poured in the mold. The material may then be hardened or otherwise cured to be rigid. In this example, the electrical leads (FIG. 4, 430) and electrical interface (FIG. 1, 114) may be disposed within the rigid insert molded lead frame (FIG. 4, 424), with a pad portion of the electrical interface (FIG. 1, 114) exposed so as to be able to contact electrical contacts on a printer.

In some examples, multiple rigid substrates (FIG. 1, 102) may be formed at the same time. That is, multiple sets of electrical leads (FIG. 4, 430) and electrical interfaces (FIG. 1, 114) may be placed in a single mold that forms a panel of rigid insert molded lead frames (FIG. 4, 424).

Next, the fluidic die (FIG. 1, 104) are joined (block 1003) to the rigid substrate (FIG. 1, 102). In the case that a panel of rigid substrates (FIG. 1, 102) are formed, multiple fluidic die (FIG. 1, 104) are joined to respective rigid substrates (FIG. 1, 102) on the panel. Thus in this fashion, fluidic die assemblies (FIG. 1, 100) may be formed in a batch mode.

The electrical connections may be formed (block 1004) between the fluidic die (FIG. 1, 104) on a rigid substrate (FIG. 1, 102) and the electrical interfaces (FIG. 1, 114) on the rigid substrate (FIG. 1, 102). This may be done as described above in connection with FIG. 3. In the case where the fluidic die assemblies (FIG. 1, 100) are formed on a panel, at some point the individual fluidic die assemblies (FIG. 1, 100) are singulated, meaning they are separated from the panel. The bends are then formed (block 1005) to form the angled fluidic die assemblies (FIG. 1, 100) as described above in connection with FIG. 3.

In summary, such a fluidic die assembly 1) provides a carrier for a fluidic die that avoids ink compatibility issues, 2) facilitates use of smaller fluidic die, 3) can be manufactured at lower cost and lower complexity, and 4) can be manufactured in a batch operation.

What is claimed is:

1. A fluidic die assembly, comprising:

a rigid substrate having a bend therein;

a fluidic die disposed on the rigid substrate, the fluidic die to eject fluid from a reservoir of a print device cartridge, which reservoir is fluidly coupled to the fluidic die, wherein the fluidic die comprises an array of ejection subassemblies, each ejection subassembly comprising:

an ejection chamber to hold a volume of fluid;

an opening; and a fluid actuator to eject a portion of the volume of fluid through the opening; and an electrical interface disposed on the rigid substrate to establish an electrical connection between the fluidic die and a controller, wherein:

the fluidic die and the electrical interface are disposed on a same surface on opposite sides of the bend; and the fluidic die and the electrical interface are disposed on orthogonal surfaces of the print device cartridge.

2. The fluidic die assembly of claim 1, wherein the rigid substrate is a thermoplastic material to bend in the presence of thermal energy.

3. The fluidic die assembly of claim 1, wherein the rigid substrate is a thermoset material with a gap at a location of the bend.

4. The fluidic die assembly of claim 1, wherein the rigid substrate is a thermoset material with a thermoplastic region at a location of the bend.

5. The fluidic die assembly of claim 1, further comprising a relief structure at a location of the bend to facilitate formation of the bend.

6. The fluidic die assembly of claim 1, comprising an overmold disposed around non-ejecting surfaces of the fluidic die, wherein a back surface of the overmold provides a connection surface between the fluidic die and the rigid substrate.

7. The fluidic die assembly of claim 1, wherein the fluidic die is molded into the rigid substrate.

8. The fluidic die assembly of claim 1, further comprising a number of channels formed in the rigid substrate having a bend therein.

9. The fluidic die assembly of claim 1, wherein the fluidic die and electrical interface are removed from the bend in the rigid substrate.

10. The fluidic die assembly of claim 1, wherein electrical leads connecting the fluidic die to the electrical interface are embedded in the rigid substrate having a bend therein.

11. A method, comprising:

joining a fluidic die having an array of ejection subassemblies to a rigid substrate, the rigid substrate comprising an electrical interface to establish an electrical connection between the fluidic die and a print device in which the fluidic die is inserted;

forming an electrical connection between electrical leads of the fluidic die and the electrical interface;

pouring a plastic material over the electrical leads and the electrical interface such that the electrical leads and electrical interface are disposed within the rigid substrate;

curing the plastic material;

exposing the electrical interface to facilitate contact with electrical contacts on the print device; and forming a bend in the rigid substrate between the fluidic die and the electrical interface such that the fluidic die and the electrical interface are disposed on orthogonal surfaces of a print device cartridge.

12. The method of claim 11, further comprising forming the rigid substrate by:

coupling electrical leads to the electrical interface; and molding a plastic substrate around the electrical leads and electrical interface to form the rigid substrate, wherein the electrical interface is exposed through the plastic substrate.

13. The method of claim 11, wherein:

forming the electrical connection between the fluidic die and the electrical interface comprises wire-bonding the fluidic die to the electrical interface; and the method further comprises disposing an encapsulant over the electrical connection.

14. The method of claim 11, wherein:

multiple rigid substrates are formed on a panel; and multiple fluidic die are simultaneously joined to corresponding rigid substrates of the multiple rigid substrates.

15. The method of claim 11, wherein forming a bend in the rigid substrate between the fluidic die and the electrical interface comprises applying heat to a location of the bend and bending the rigid substrate.

16. The method of claim 11, wherein forming a bend in the rigid substrate between the fluidic die and the electrical interface comprises bending the rigid substrate over a pin at a location of the bend.

17. The method of claim 16, wherein the pin is heated.

18. A print device cartridge, comprising:

a housing;

a reservoir disposed within the housing to contain a printing fluid; and a fluidic die assembly disposed on two surfaces of the housing, the fluidic die assembly comprising:

a rigid insert molded lead frame having a uniform thickness and an orthogonal bend therein, wherein a composition of the rigid insert molded lead frame is different at the orthogonal bend than at straight portions of the rigid insert molded lead frame;

a fluidic die disposed on the rigid insert molded lead frame, the fluidic die to eject fluid from the reservoir fluidly coupled to the fluidic die, wherein the fluidic die comprises an array of ejection subassemblies;

an electrical interface disposed on the rigid insert molded lead frame to establish an electrical connection between the fluidic die and a controller, wherein the fluidic die and the electrical interface are disposed on orthogonal surfaces of the print device cartridge;

a number of fluid channels disposed through the rigid insert molded lead frame to direct the printing fluid from the reservoir to the fluidic die;

wherein the fluidic die and the electrical interface are disposed on a same surface on opposite sides of the bend.

19. The cartridge of claim 18, wherein the rigid insert molded lead frame comprises a pocket in which the fluidic die is disposed.

20. The cartridge of claim 18, further comprising an adhesive to join the fluidic die to the rigid insert molded lead frame.

* * * * *